US010415230B1

(12) United States Patent
Abbas et al.

(10) Patent No.: US 10,415,230 B1
(45) Date of Patent: Sep. 17, 2019

(54) STRENGTHENING SYSTEM FOR BEAM-COLUMN CONNECTION IN STEEL FRAME BUILDINGS TO RESIST PROGRESSIVE COLLAPSE

(71) Applicant: KING SAUD UNIVERSITY, Riyadh (SA)

(72) Inventors: Husain Abbas, Riyadh (SA); Yousef A. Al-Salloum, Riyadh (SA); Tarek H. Almusallam, Riyadh (SA); Hussein Mohamed Elsanadedy, Riyadh (SA); Mohammad Alrubaidi, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/152,229

(22) Filed: Oct. 4, 2018

(51) Int. Cl.

| | |
|---|---|
| ***E04B 1/24*** | (2006.01) |
| ***E04B 1/98*** | (2006.01) |
| ***E04H 9/04*** | (2006.01) |
| *E04H 9/02* | (2006.01) |

(52) U.S. Cl.
CPC ..... *E04B 1/2403* (2013.01); *E04B 1/98* (2013.01); *E04H 9/04* (2013.01); *E04B 2001/2415* (2013.01); *E04B 2001/2442* (2013.01); *E04B 2001/2445* (2013.01); *E04B 2001/2457* (2013.01); *E04H 9/024* (2013.01)

(58) Field of Classification Search
CPC .. E04B 1/2403; E04B 1/98; E04B 2001/2415; E04B 2001/2442; E04B 2001/2445; E04B 2001/2457; E04H 9/04; E04H 9/024
See application file for complete search history.

(56) References Cited

U.S. PATENT DOCUMENTS 2,037,736 A * 4/1936 Payne ..... E04B 1/2604 403/173
5,660,017 A * 8/1997 Houghton ..... E04B 1/2403 52/167.3
5,806,265 A * 9/1998 Sluiter ..... E04B 1/58 52/643

(Continued)

OTHER PUBLICATIONS

Crawford "Retrofit Methods to Mitigate Progressive Collapse," Karagozian & Case Structural Engineers, 2018, https://cdn.ymaws.com/www.nibs.org/resource/resmgr/MMC/wppc_crawfords_paper.pdf.

(Continued)

*Primary Examiner* — Beth A Stephan
(74) *Attorney, Agent, or Firm* — Richard C. Litman

(57) ABSTRACT

The strengthening system for beam-column connections in steel frame buildings to resist progressive collapse helps to mitigate progressive collapse in the event of accidental column loss by using a system of rippled steel plates reinforcing the beam-column connection. Various configurations of rippled steel plates are provided to connect in-plane and transverse beams at a joint. In the event of severe damage caused to a column of a steel framed building, the upper joints of the damaged column undergo downward movement. The rippled plates at the joint straighten during the initial downward movement, and resist further downward movement after complete straightening of the ripples. This helps in the development of catenary action in steel beams. The proposed system is simple, fast to construct, demountable, and easy to repair/replace after damage caused by blast loads.

19 Claims, 17 Drawing Sheets

(56) References Cited

U.S. PATENT DOCUMENTS 6,138,427 A * 10/2000 Houghton ..... E04B 1/2403 52/236.3
6,516,583 B1 * 2/2003 Houghton ..... E04B 1/24 52/167.3
6,755,003 B1 * 6/2004 McGrath ..... E04B 1/82 52/650.1
7,178,296 B2 * 2/2007 Houghton ..... E04B 1/24 52/167.3
7,874,120 B2 * 1/2011 Ohata ..... E04B 1/2403 52/653.1
8,146,322 B2 * 4/2012 Karns ..... E04B 1/2403 52/653.1
8,161,707 B2 * 4/2012 Simmons ..... E04B 1/24 52/648.1
8,205,408 B2 6/2012 Houghton et al.
8,468,775 B2 * 6/2013 Vaughn ..... E02D 27/34 403/200
8,701,359 B2 * 4/2014 Packer ..... E04B 1/24 403/270
9,506,239 B2 * 11/2016 Houghton ..... E04B 1/2403
9,765,521 B1 9/2017 Abbas et al.
2002/0124520 A1 * 9/2002 Bock ..... E04B 1/2403 52/655.1
2003/0208985 A1 * 11/2003 Allen ..... E04B 1/2403 52/653.1
2005/0204684 A1 * 9/2005 Houghton ..... E04B 1/24 52/653.1
2011/0030305 A1 2/2011 Karns
2015/0159369 A1 7/2015 Chen et al.
2015/0275501 A1 10/2015 Houghton

OTHER PUBLICATIONS

Lin et al., "Experimental study of a novel multi-hazard resistant prefabrication concrete frame structure," Soil Dynamics and Earthquake Engineering, Available online Apr. 13, 2018, http://www.luxinzheng.net/publication7/2018-SDEE-MHRPC_Test.htm.

* cited by examiner

STRENGTHENING SYSTEM FOR BEAM-COLUMN CONNECTION IN STEEL FRAME BUILDINGS TO RESIST PROGRESSIVE COLLAPSE

BACKGROUND

1. Field

The disclosure of the present patent application relates to beam-column connections in steel frame buildings, and particularly to a strengthening system for beam-column connection in steel frame buildings to resist progressive collapse.

2. Description of the Related Art

The use of steel frames in building construction is quite popular, as it offers many advantages over traditional reinforced concrete, which include lower costs, sustainability, and flexibility. The use of prefabricated steel buildings takes advantage of offsite prefabrication to improve the speed of erection and independence from the weather. Additionally, cost control is achieved through increased productivity in its design, fabrication, and erection. A relatively shorter construction period helps in early possession of the building for use or rent and lowers financing costs. Other benefits of steel framed construction include large unsupported spans, slender columns resulting in maximizing floor area, excellent strength-to-weight ratio, resulting in lower foundation costs, easy integration of services, better quality control, and greater flexibility for future modifications.

Although the plastic behavior of steel provides additional security in extreme loading situations, several steel buildings have witnessed progressive collapse due to exposure to blast loads. The performance of steel-framed buildings under normal service, as well under extreme loads, depends primarily on the behavior of beam-column connections. The connection details affect the constructability, stability, strength, flexibility, residual forces, and ductility of the structure.

"Progressive collapse" is the propagation of an initial local failure from one part to the adjoining parts, and eventually collapse of the entire building or a large part of it. To resist progressive collapse of buildings, the alternate path method is normally employed in the design. In this method, alternate paths are available for load transfer if one critical component (e.g., a column) fails, and thus progressive collapse does not occur. In the event of localized failures due to blast or seismic events, steel-framed structures are required to have well-defined redundancies so that alternative load paths are available through the formation of catenary action, which is greatly lacking in currently available beam-column connections.

Thus, a strengthening system for beam-column connections in steel frame buildings to resist progressive collapse solving the aforementioned problems is desired.

SUMMARY

The strengthening system for beam-column connections in steel frame buildings to resist progressive collapse helps to mitigate progressive collapse in the event of accidental column loss by using a system of rippled steel plates reinforcing the beam-column connection. Various configurations of rippled steel plates are provided to connect in-plane and transverse beams at a joint. In the event of severe damage caused to a column of a steel framed building, the upper joints of the damaged column undergo downward movement. The rippled plates at the joint straighten during the initial downward movement, and resist further downward movement after complete straightening of the ripples. This helps in the development of catenary action in steel beams. The proposed system is simple, fast to construct, demountable, and easy to repair/replace after damage caused by blast loads.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The strengthening system for beam-column connections in steel frame buildings to resist progressive collapse helps to mitigate progressive collapse in the event of accidental column loss by using a system of rippled steel plates reinforcing the beam-column connections. Various configurations of rippled steel plates are provided to connect in-plane and transverse beams at a joint. In the event of severe damage caused to a column of a steel framed building, the upper joints of the damaged column undergo downward movement. The rippled plates at the joint straighten during the initial downward movement, and resist further downward movement after complete straightening of the ripples. This helps in the development of catenary action in steel beams. The proposed system is simple, fast to construct, demountable, and easy to repair/replace after damage caused by blast loads.

Figure 1:
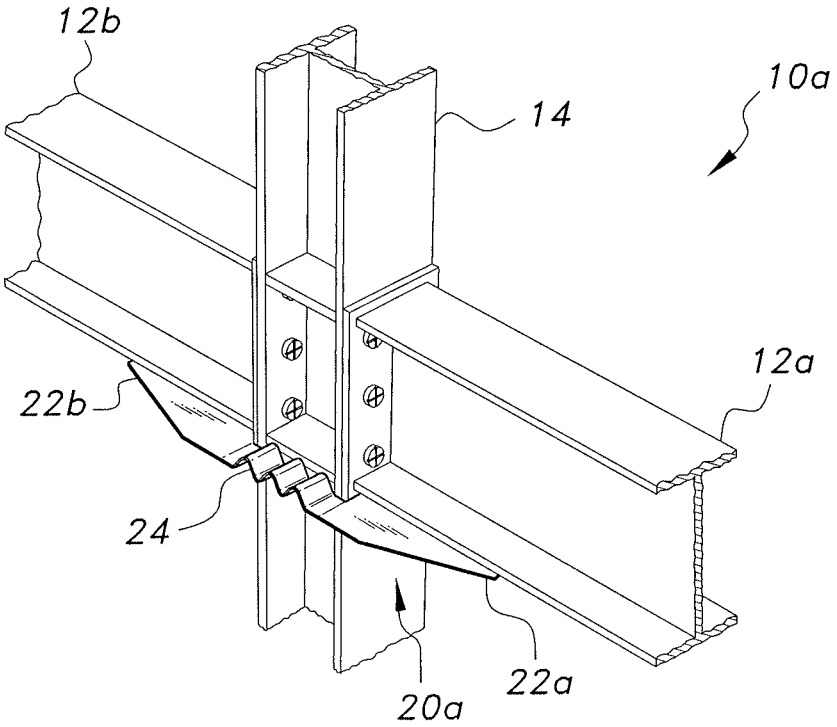
FIG. 1 is a perspective view of a first embodiment of a strengthening system for beam-column connection in steel frame buildings to resist progressive collapse for a semi-rigid connection, showing horizontal rippled plates in an unextended condition and a flexible end plate attached across the end of the beam.
Figure 2:
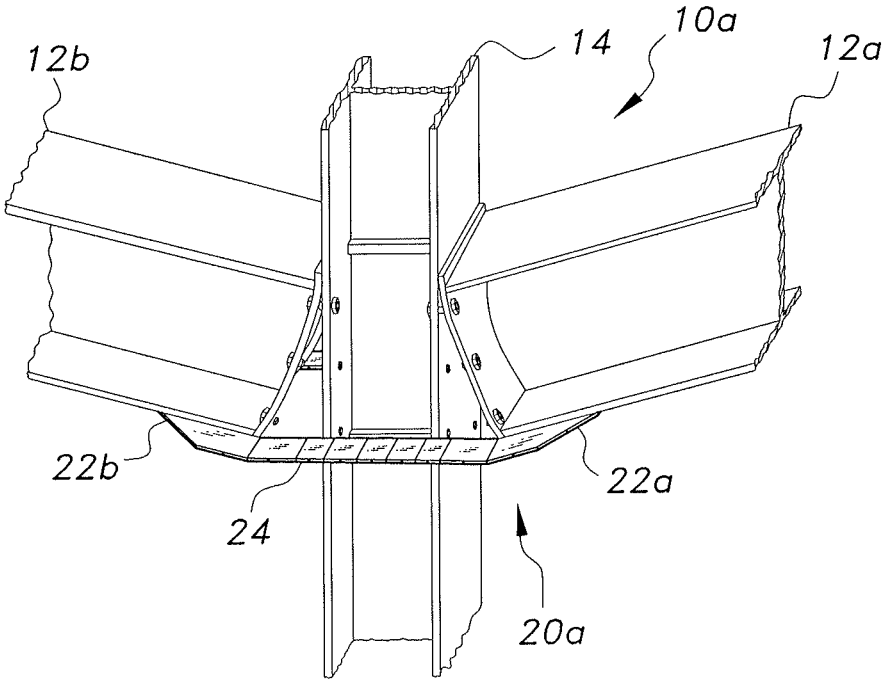
FIG. 2 is a perspective view of the strengthening system of FIG. 1, showing the rippled plates in an extended condition after downward movement of the joint due to exposure to blast loads.

In the event of a structural failure, such as a failure caused by blast loads, where the lower portion of the column becomes unsupported, downward movement by the column will create large amounts of stress and typically failure at the beam-column connection. Specifically, when the column displaces vertically downward, a bending force is applied to the beams of the beam-column connection. The bending is resisted by the bolts of the beam column connection. However, when the force reaches a certain threshold, the bolts will fail, as seen in FIG. 2. The greatest stress will be directed at the lowest bolt, which will fail first, thus resulting in less structural integrity of the joint and complete failure. Therefore, adding additional structure that resists the lower portion of the beam from pulling away can maintain the integrity of the joint. By maintaining the integrity of the joint, the beams can transfer the gravity loads to the adjacent columns and provide support for the column, thus preventing progressive collapse.

FIGS. 1-4 depict a first embodiment of the strengthening system for beam-column connection in steel frame buildings to resist progressive collapse for a semi-rigid connection. As seen in FIGS. 1-4, two rippled plates 20*a*, 20*b* are secured across a bottom of a semi-rigid beam-column connection 10*a*, or beam-column joint. The rippled plates' 20 first resistive measure is impulse dissipation by spreading the large initial force caused by the beam dropping down to a lower force over a longer period of time. This is achieved through straightening of the ripples 24 on the plates 20*a*, 20*b*. The force from the plates 20*a*, 20*b* counters a separating force at the lower edge of the beams 12*a*, 12*b*. Once the ripples 24 are straightened and a large amount of the force on the joint 10*a* has been dispersed, the tensile strength of the straightened plate will counteract the remaining force, thus retaining the connection between the beams 12*a*, 12*b* and the column 14. The beams 12*a*, 12*b* will then be able to support the column 14 by transferring the load to adjacent columns.

The first embodiment includes a first rippled plate 20*a* and a second rippled plate 20*b* at the joint 10*a*, the plates 20*a*, 20*b* being positioned on opposite sides of the column 14. Each plate 20*a*, 20*b* includes a first mounting tab 22*a* and a second mounting tab 22*b* connected by a rippled portion 24. Each mounting tab 22*a*, 22*b* may be shaped as a rectangle having a right trapezoid extending coplanar from one side thereof. The rippled portion 24 has a rectangular cutout defined therein to that the rippled plate can extend around the column 14, the mounting tabs 22*a*, 22*b* being welded to the bottom flange of the beams 12*a*, 12*b* on opposite sides of the I-beam column. Accordingly, when both plates 20*a*, 20*b* are installed on a joint 10*a*, the plates 20*a*, 20*b* will completely wrap around the column 14 and the rippled portions 24 will span opposing sides of the column 14, extending for a distance equal to the distance between the column flanges.

Figure 3:
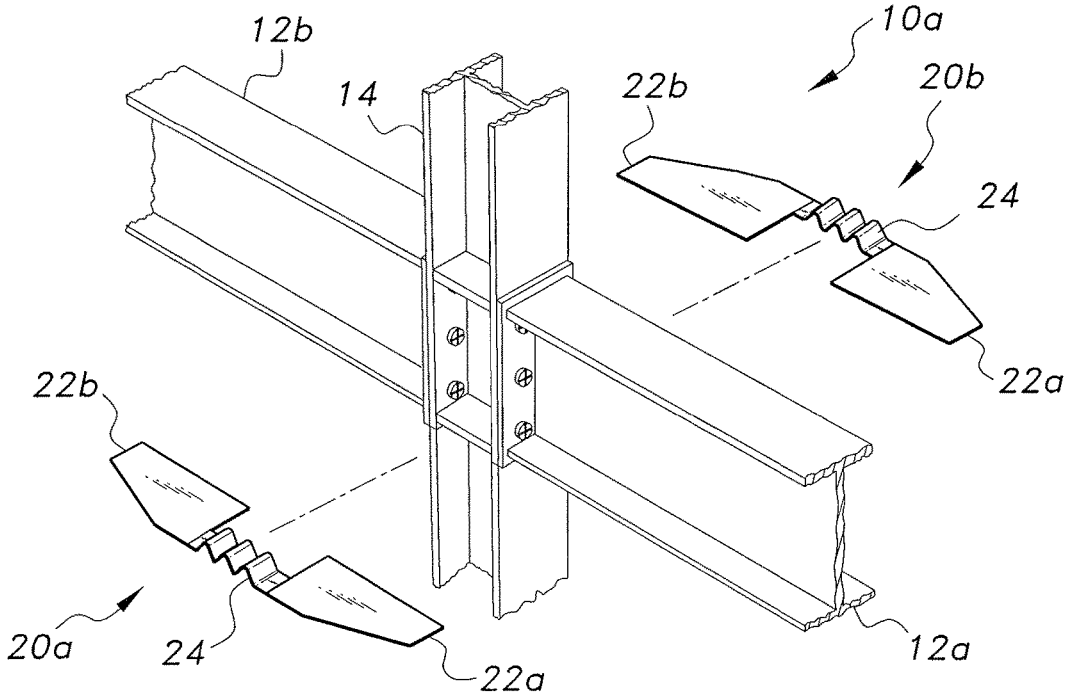
FIG. 3 is a partially exploded perspective view of the strengthening system of FIG. 1.
Figure 4:
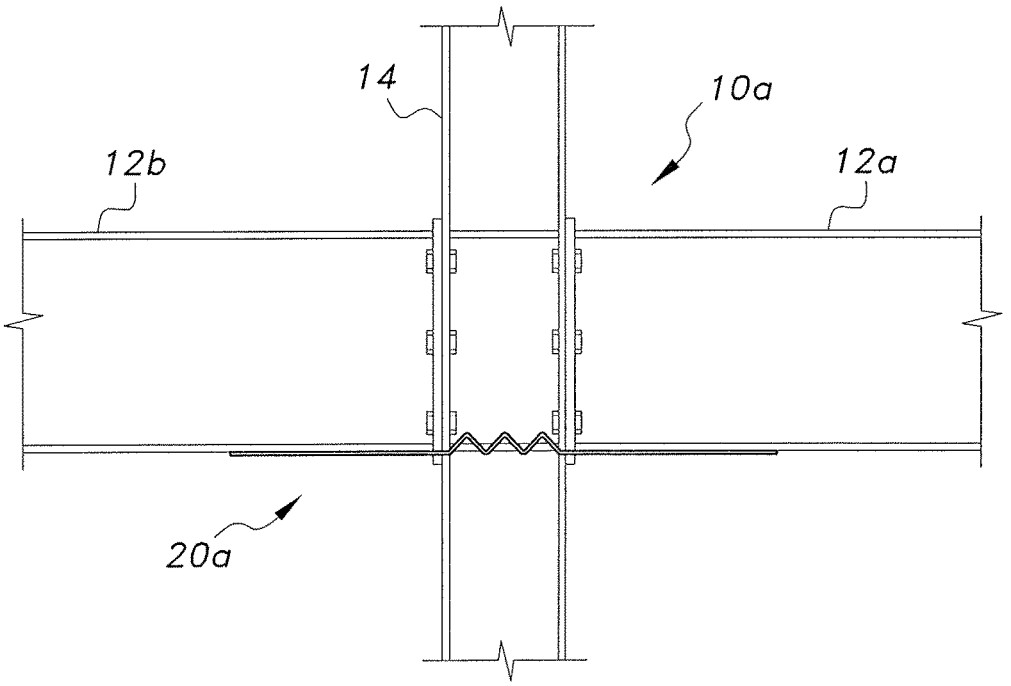
FIG. 4 is a front elevation view of the strengthening system of FIG. 1.

When installed on the beam-column joint 10*a*, the first mounting tab 22*a* is connected to the lower flange of a beam 12*a* at a location immediately adjacent the column 14. The second mounting tab 22*b* is connected to the lower flange of the opposite beam 12*b* at a location immediately adjacent the column 14, with the rippled section 24 spanning the column 14. The mounting tab 22*a*, 22*b* may be welded or connected by high strength bolts to the beams 12*a*, 12*b*. The plates 20*a*, 20*b* are attached on opposite sides of the column 14, as shown in FIG. 3, so rippled portions 24 span each side. This prevents unbalanced forces on the beam-column connection 10*a* that may result in additional stress on the structure.

FIG. 2 shows the rippled plates 20*a*, 20*b* after a structural failure of the column 14 at a location below the joint 10*a*. The outward forces on the lower portions of the beams 12*a*, 12*b* have straightened the rippled sections 24, but the integrity of the joint is maintained through the tensile strength of the straightened plates 20*a*, 20*b*.

Figure 5:
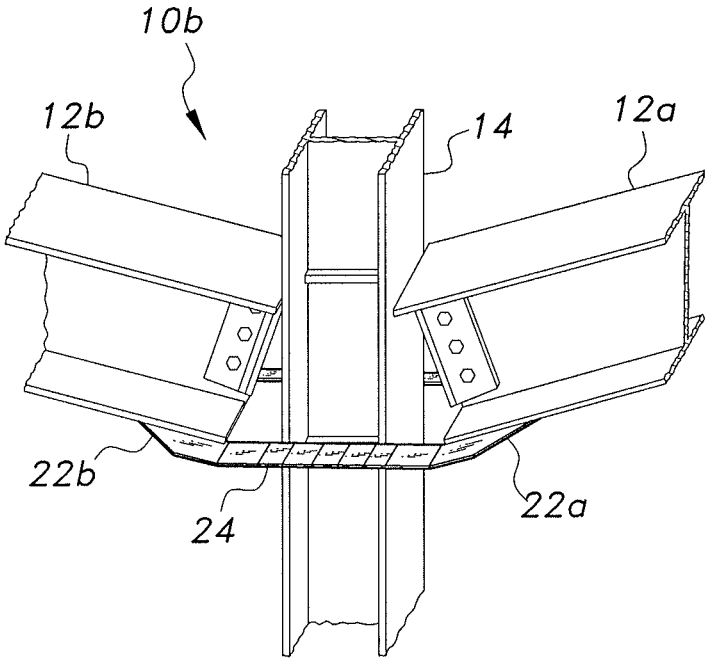
FIG. 5 is a perspective view of an embodiment of a strengthening system for beam-column connection in steel frame buildings to resist progressive collapse for a fin plate connection, showing horizontal rippled plates with the rippled plates in an extended condition after downward movement of the joint due to exposure to blast loads.
Figure 6:
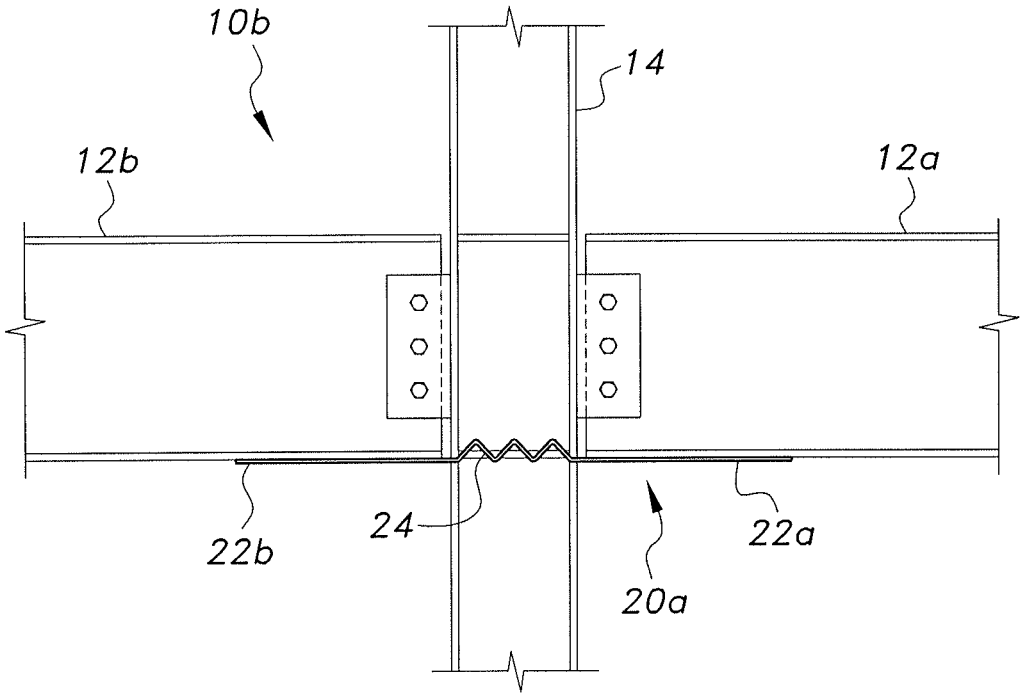
FIG. 6 is a front elevational view of the strengthening system FIG. 5, shown with the rippled plates in an unextended condition.
Figure 7:
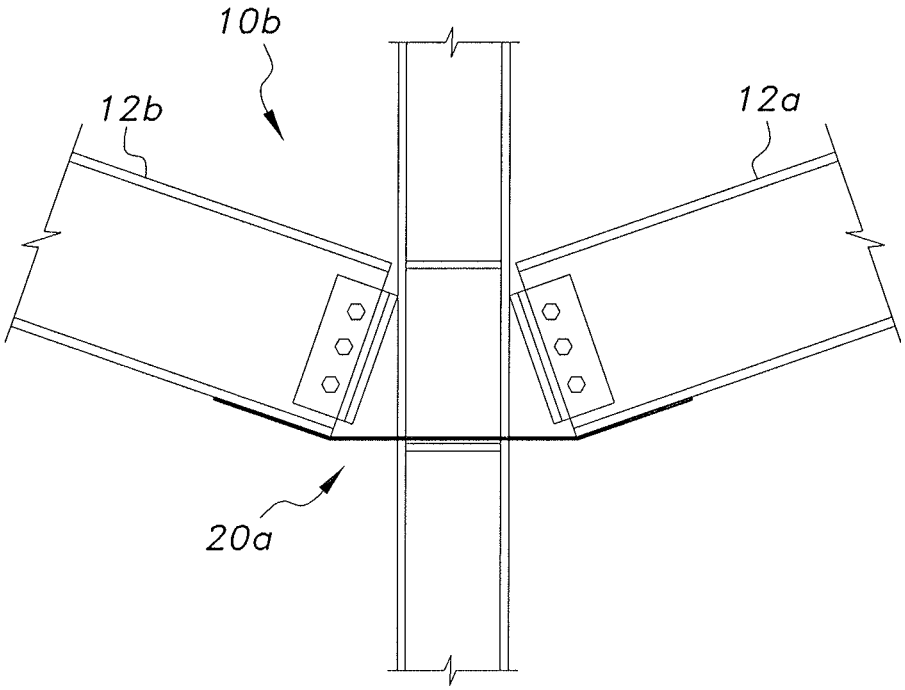
FIG. 7 is a front elevation view of the strengthening system of FIG. 5, shown with the rippled plates in an extended condition after downward movement of the joint due to exposure to blast loads.

The beam-column joint 10*a* of FIGS. 1-4 has a flexible end plate attached to the end of the beams 12*a*, 12*b*, the flexible end plate being bolted to the flanges of the column 14. However, the same horizontal rippled plate strengthener may also be used with a beam-column joint 10*b* having a fin plate welded to the column 14 and bolted to the web of the beam 12*a*, 12*b*, as shown in FIGS. 5-7. Similar to the semi-rigid beam connection 10*a*, when the beam-column connection is fully intact, the first and second connection plates 22*a*, 22*b* are connected to the opposing beams 12*a*, 12*b* adjacent the column with the rippled plates 24 spanning the column 14.

FIGS. 6 and 7 show the beam-column joint 10*b* after the column 14 fails at a location below the joint and the joint moves downward. Just as with the semi-rigid beam connection 10*a*, the ripples 24 spread the initial outward force on the lower portions of the beams 12*a*, 12*b* over a length of time, resulting in the plates 20*a*, 20*b* being straightened. Once the plates 20*a*, 20*b* have been straightened, the tensile strength of the plates 20*a*, 20*b* is adequate to prevent the beams 12*a*, 12*b* from separating further, thus mitigating progressive collapse.

Figure 8:
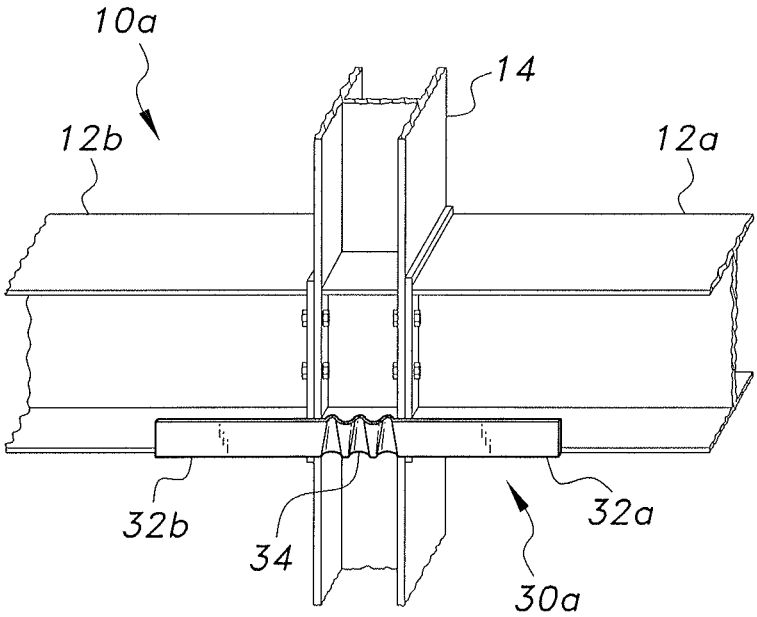
FIG. 8 is a perspective view of a second embodiment of a strengthening system for beam-column connection in steel frame buildings to resist progressive collapse for a semi-rigid connection, showing vertical rippled plates in an unextended condition and a flexible end plate attached across the end of the beam.
Figure 9:
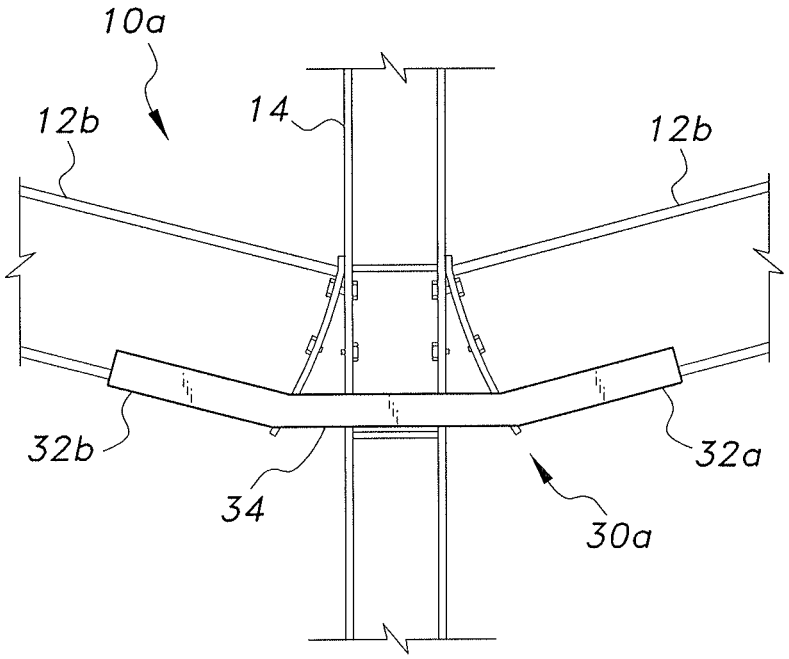
FIG. 9 is a front elevation view of the strengthening system of FIG. 8, shown with the vertical rippled plates in an extended condition after exposure to blast loads.
Figure 10:
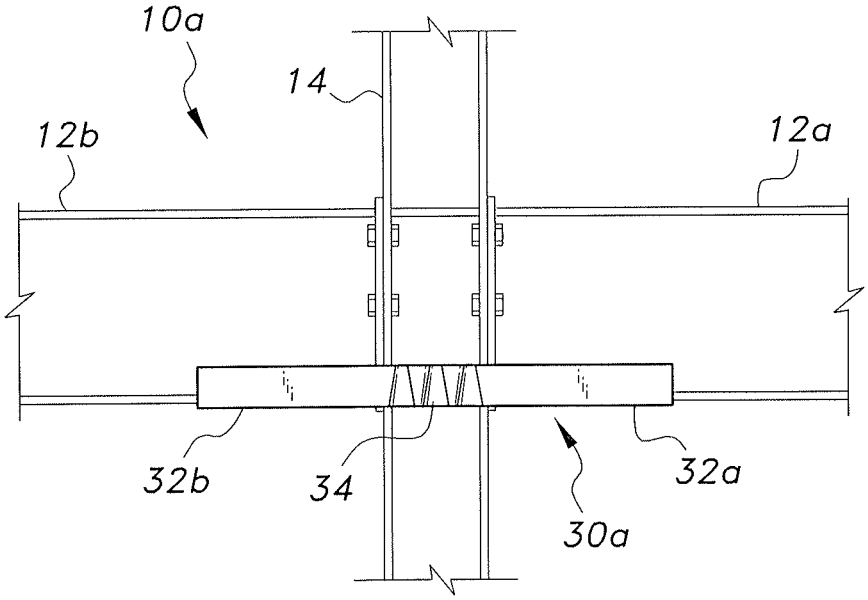
FIG. 10 is a front elevation view of the strengthening system of FIG. 8, shown with the vertical rippled plates in an unextended condition.
Figure 11:
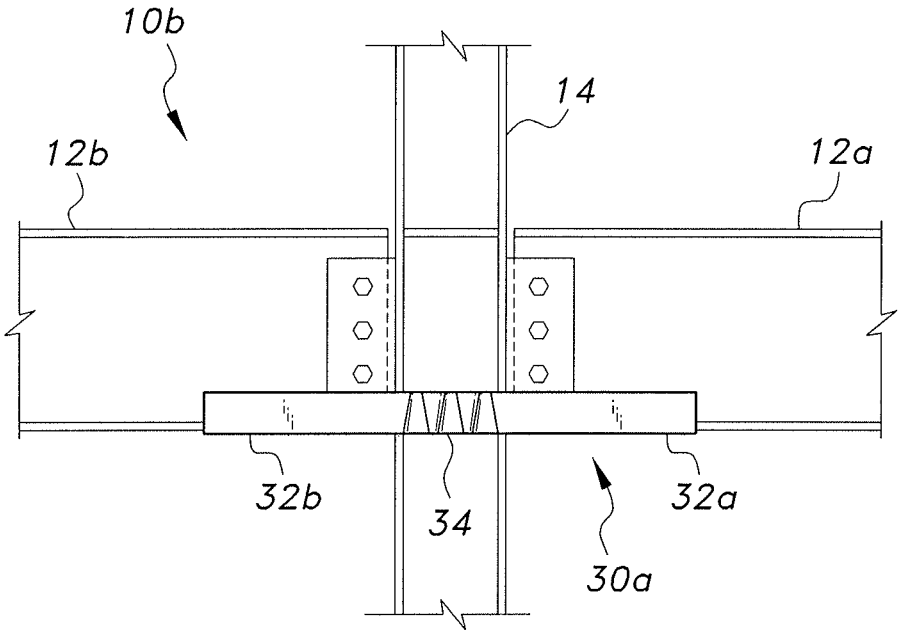
FIG. 11 is a front elevation view of an embodiment of a strengthening system for beam-column connection in steel frame buildings to resist progressive collapse for a fin plate connection, showing vertical rippled plates in an unextended condition.

FIGS. 8-11 depict a second embodiment of the strengthening system for beam-column connections in steel frame buildings to resist progressive collapse. The second embodiment includes plates 30*a*, 30*b* having vertically oriented rippled sections 34, as opposed to the horizontally oriented rippled sections of the first embodiment. The plates 30*a*, 30*b* have a first mounting portion 32*a* and a second mounting portion 32*b* for attaching to the two beams 12*a*, 12*b* on opposite sides of the vertical column 14. The first and second mounting portions 32*a*, 32*b* are L-shaped, having a lower horizontal flange welded beneath the lower flange of the corresponding beams 12*a*, 12*b*. The vertical flange provides adequate structure to support the vertically oriented rippled portions 24. FIGS. 8-10 show the plates 30*a*, 30*b* installed on a semi-rigid beam-column joint 10*a* having a flexible end plate, and FIG. 11 shows the plates 30*a*, 30*b* installed on a fin plate beam-column joint 10*b*. Similar to the first embodiment, two plates 30*a*, 30*b* may be used on each joint, one on each side of the column 14.

Unlike the connection portions 30*a*, 30*b*, the rippled portion 34 has only a vertically oriented rippled portion and no horizontal portion. The ripples or corrugations are tapered, with the widest point of the ripples being at the bottom of the rippled portion 34 and the narrowest point being at the top of the rippled portion 34. The taper of the ripples may be determined based on the angle at which the beams 12*a*, 12*b* separate from the column 14. As seen in FIG. 9, the lower portion of the rippled portion 24 expands more than the upper portion when the beams 12*a*, 12*b* separate. Thus, in a preferred embodiment, the taper of the ripple matches the angle at which the beams separate from the column, so uniform force is applied by the rippled section during the angular separation. The taper of the ripples may be determined based on the vertical height of the beams 12*a*, 12*b*.

Vertical rippled plates 30*a*, 30*b* may be desired when there is no space for the horizontal projections of the horizontal ripple plates. For example, the vertical plate may be the easiest to install when the plates are being retrofitted to a pre-existing structure. Alternatively, the horizontal ripple pates 20*a*, 20*b* may be desirable when there is no space, or it is hard to access the space, immediately next to the column 14, but the area immediately below the beams 12*a*, 12*b* is readily accessible.

Figure 12:
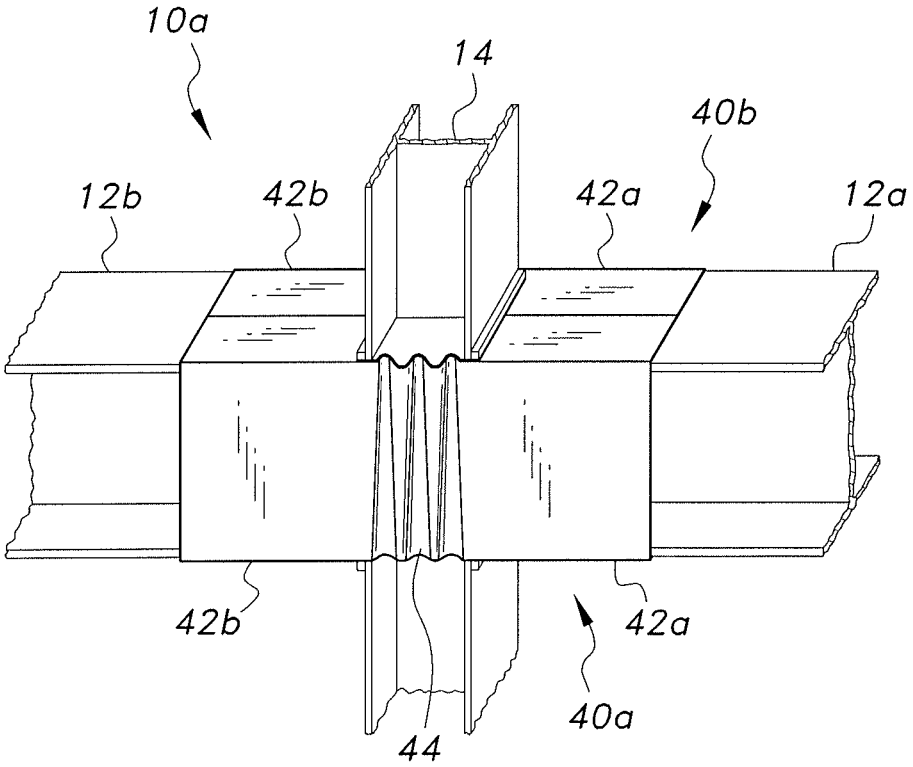
FIG. 12 is a perspective view of a third embodiment of a strengthening system for beam-column connection in steel frame buildings to resist progressive collapse, showing vertical rippled plates in an unextended condition, the vertical rippled plates extending from flange to flange of the beam.
Figure 13:
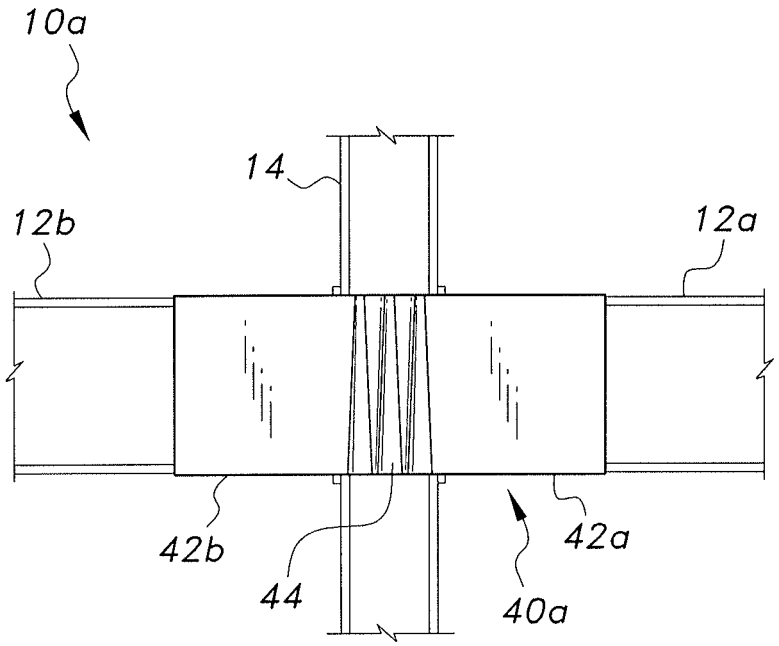
FIG. 13 is a front elevation view of the strengthening system of FIG. 12, shown with the vertical rippled plates in an unextended condition.
Figure 14:
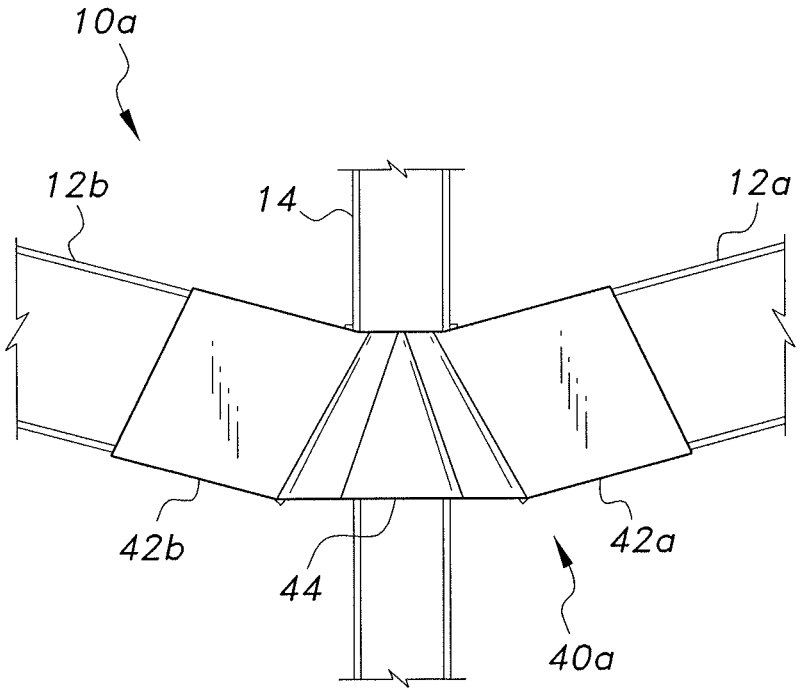
FIG. 14 is a front elevation view of the strengthening system of FIG. 12, shown with the vertical rippled plates in an extended condition after downward movement of the joint due to exposure to blast loads.

The vertically oriented ripple plates may extend a portion of the way up the beam, as shown by the rippled plates 30*a*, 30*b* of FIGS. 8-11, or may extend up the entire height of the web of the beam, as shown by the rippled plates 40*a*, 40*b* in FIGS. 12-14. The first mounting portion 42*a* and second mounting portion 42*b* for the plates 40*a*, 40*b*, which extend up the entire height of the beam, may be U-shaped so that the plates 40*a*, 40*b* may be connected to the upper and lower flanges of the beams 12*a*, 12*b*. The full height plates 40*a*, 40*b* may be used in situations that require added strength, or alternatively, in situations where a thinner plate is desired.

FIG. 14 shows the full beam height vertical plate 40*a* after the vertical column 14 has been displaced downward. Similar to the partial length vertical plates 30*a*, the tapered ripples may be tapered to match the angle that the beams 12*a*, 12*b* are expected to separate from the column 14. When the taper is matched, the rippled portion will experience consistent force throughout during the column 14 displacement.

Figure 15:
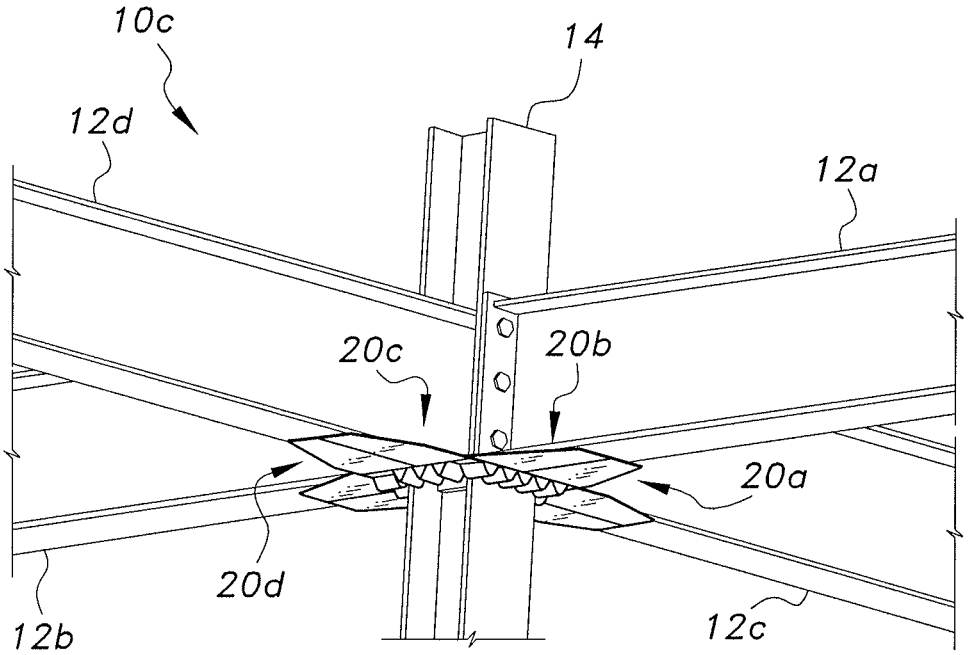
FIG. 15 is a perspective view of a fourth embodiment of a strengthening system for beam-column connection in steel frame buildings to resist progressive collapse for a semi-rigid connection, shown from below and shown with horizontal rippled plates in an unextended condition.
Figure 16:
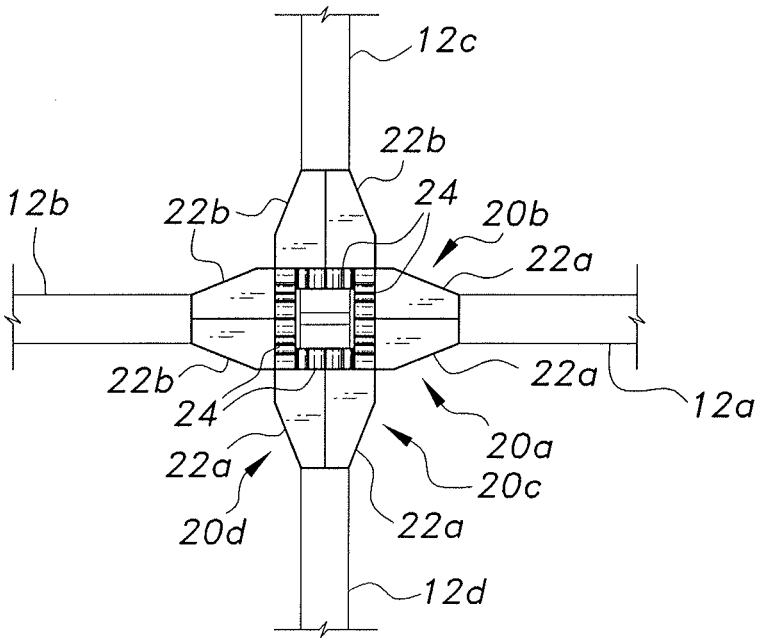
FIG. 16 is a bottom view of the strengthening system of FIG. 15, shown with the horizontal rippled plates in an unextended condition.
Figure 17:
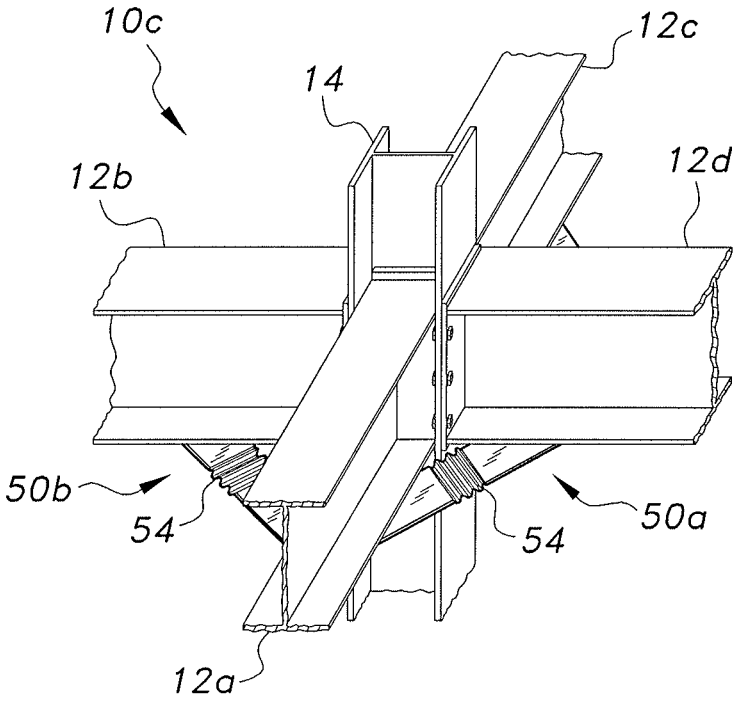
FIG. 17 is a perspective view of a fifth embodiment of a strengthening system for beam-column connection in steel frame buildings to resist progressive collapse for a semi-rigid connection, showing an internal joint and horizontal rippled plates in an unextended condition.

FIGS. 15 and 16 show a fourth embodiment of the strengthening system for beam-column connection in steel frame buildings to resist progressive collapse. This embodiment may be used on an internal beam-column joint 10*c* having four in-plane beams 12*a*, 12*b*, 12*c*, 12*d* connected to a column 14, with each beam being perpendicular to the other beams. The embodiment shown in FIGS. 15 and 16 includes four rippled plates, with each plate spanning one side of the column. The plates 20*a*, 20*b* shown in this embodiment include horizontal ripple plates similar to the first embodiment shown in FIGS. 1-7. Accordingly, each plate has a first mounting tab 22*a* and a second mounting tab 22*b* connected by the rippled portion 24 designed to span the column 14.

The plates spanning the column 14 in parallel, for example plates 20*a*, 20*b*, will work independently from the plates spanning the joint perpendicular from them, for example, plates 20*c*, 20*d*. The resultant support will include two separately operating plate sub-systems 20*a*, 20*b* and 20*c*, 20*d*. The first sub-system includes two plates 20*a*, 20*b* spanning the column 14 in parallel. These plates will only be connected to the two coplanar beams 12*a*, 12*b*. Thus, the first system 20*a*, 20*b* will exclusively prevent the two coplanar beams 12*a*, 12*b*, to which they are attached, from separating. The second sub-system will include the two plates 20*c*, 20*d*, spanning the column perpendicular to the plates 20*a*, 20*b* of the first sub-system. Similar to the first sub-system, the second sub-system will act individually and only prevent the two beams 12*c*, 12*d*, to which it is attached, from separating.

When installed on the lower side of a beam-column joint, one sub-system may be entirely installed on top of the other to assist in the independent expansion of the sub-systems. For avoiding interaction between the ripples in the two transverse directions, the length of the ripple plates can be reduced by decreasing the number of ripples and increasing the amplitude of ripples. Thus, each rippled portion will slide over the flat section when being straightened.

Figure 18:
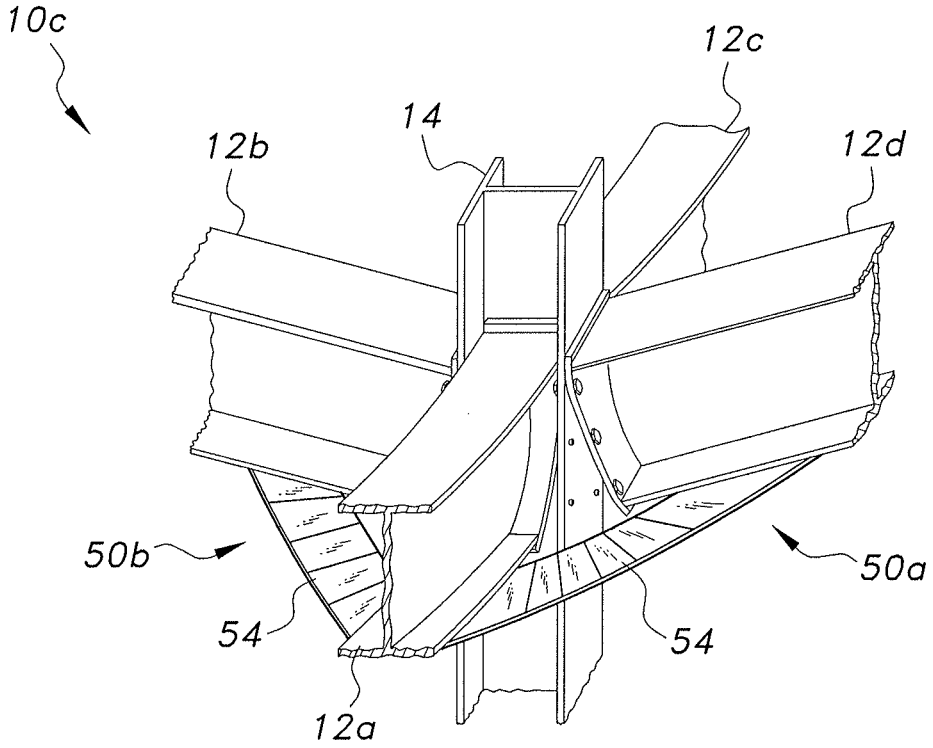
FIG. 18 is a perspective view of the strengthening system of FIG. 17, shown with the horizontal rippled plates in an extended condition after downward movement of the joint due to exposure to blast loads.
Figure 19:
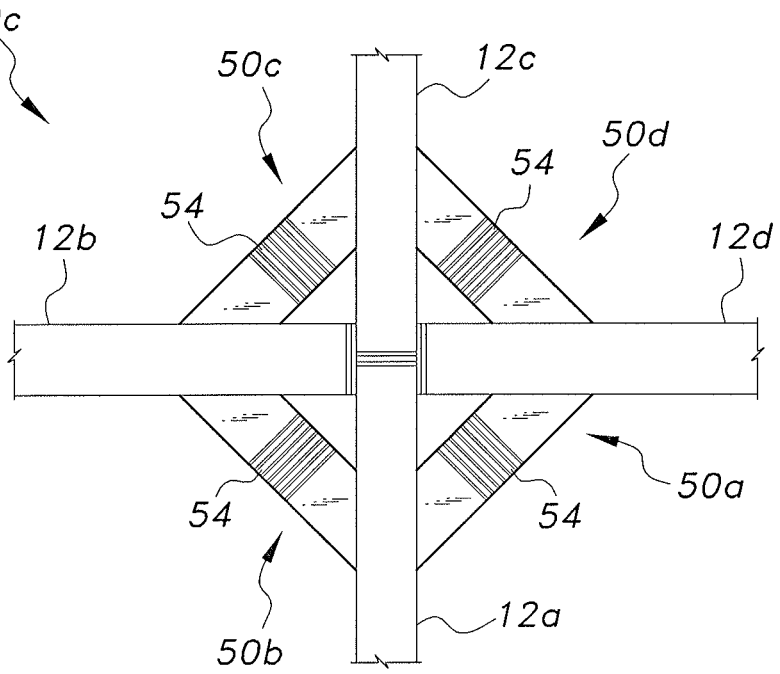
FIG. 19 is a top view of the strengthening system of FIG. 17, shown with the horizontal rippled plates in an unextended condition.
Figure 20:
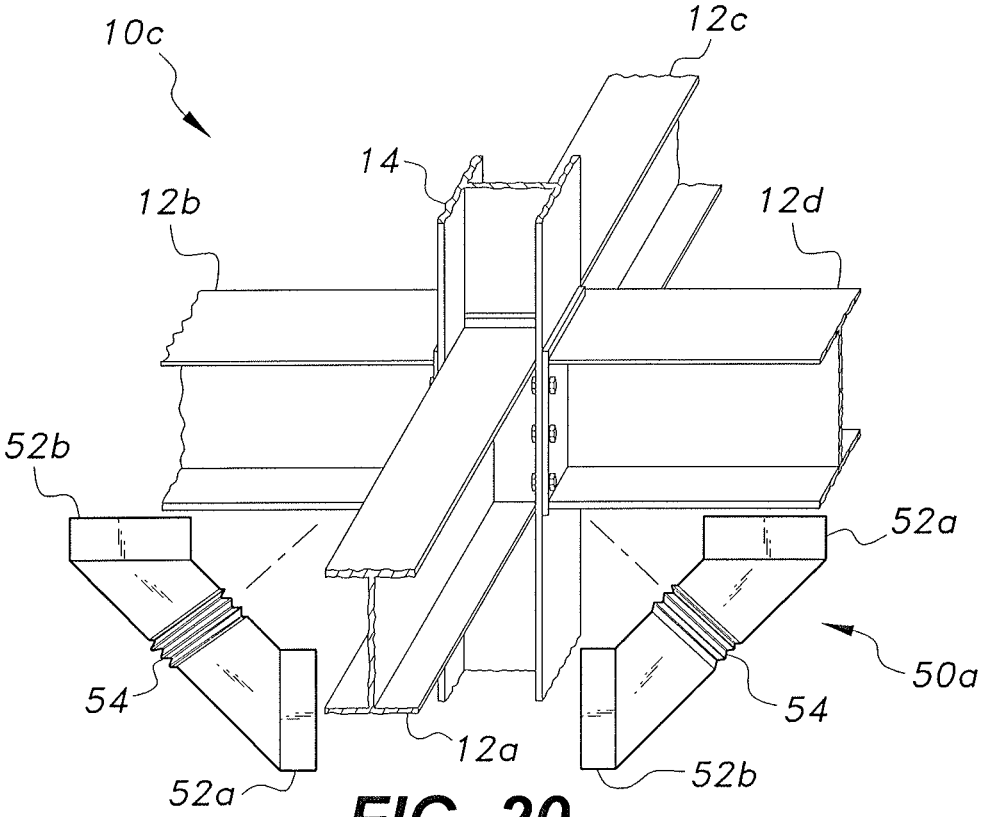
FIG. 20 is a partially exploded perspective view of the strengthening system of FIG. 17.

FIGS. 17-20 depict a fifth embodiment of the strengthening system for beam-column connection in steel frame buildings to resist progressive collapse. As seen in FIGS. 17-21, this embodiment is directed at an internal joint 10*c* connecting four perpendicular beams. Four rippled plates 50*a*, 50*b*, 50*c*, 50*d* are used to reinforce the joint, and each beam is connected to the two adjacent beams through the rippled plates. For example, beam 12*a* is connected to beams 12*b* and 12*d* by plates 50*b* and 50*a*, respectively. Each plate 50*a*, 50*b*, 50*c*, 50*d* includes a horizontally oriented rippled section 54 and two mounting portions 52*a*, 52*b*. The mounting portions 52*a*, 52*b* may be oriented at 45° from the rippled section 54 to align with the beams 12, as shown in FIG. 20. Each mounting portion 52*a*, 52*b* is connected to the lower flange of two adjacent, perpendicular beams at a location immediately next to the adjacent plate. FIG. 19 shows the plates 50*a-d* connected to the joint 10*c* from a top view. The edges of the four plates 50*a*-50*d* line up and create a square shape. Unlike the previous embodiments, the plates 50*a*-50*d* do not span the column, instead they span the gap between adjacent beams 12*a*-12*d*. Therefore, there is no potential for interference between plates.

As seen in FIG. 18, the plates retain the lower portions of each beam 12*a-d* at the joint 10*c*. The outward forces on a lower edge of each beam are transferred to the opposing beams through the plates 20*a*-20*d* and intermediate perpendicular beams. Therefore, the forces are balanced by opposing beams. As a result, the joint 10*c* remains intact, and the column 14 remains supported by the adjacent columns to which the beams' opposite ends are connected.

Figure 21:
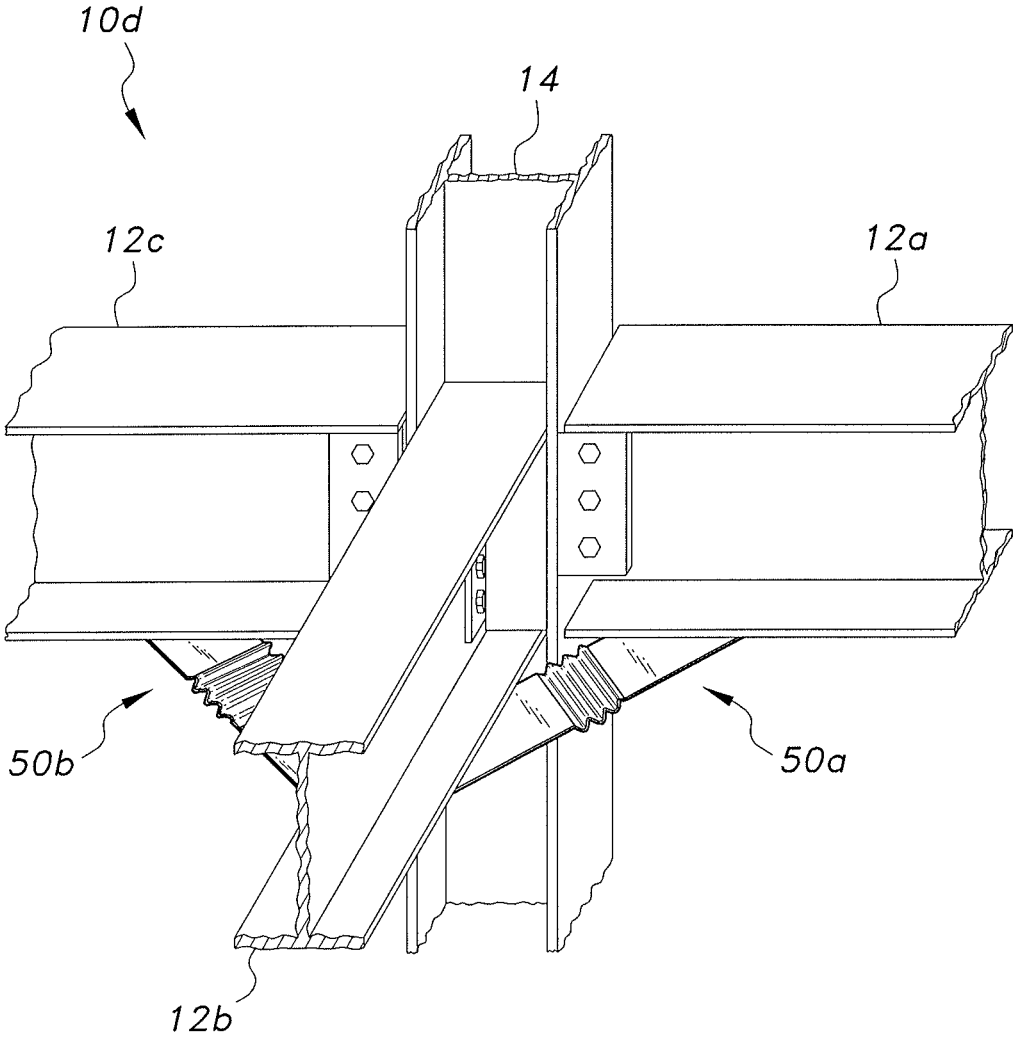
FIG. 21 is a perspective view of a sixth embodiment of a strengthening system for beam-column connection in steel frame buildings to resist progressive collapse for a fin plate connection, showing an external joint and shown with rippled plates in an unextended condition.
Figure 22:
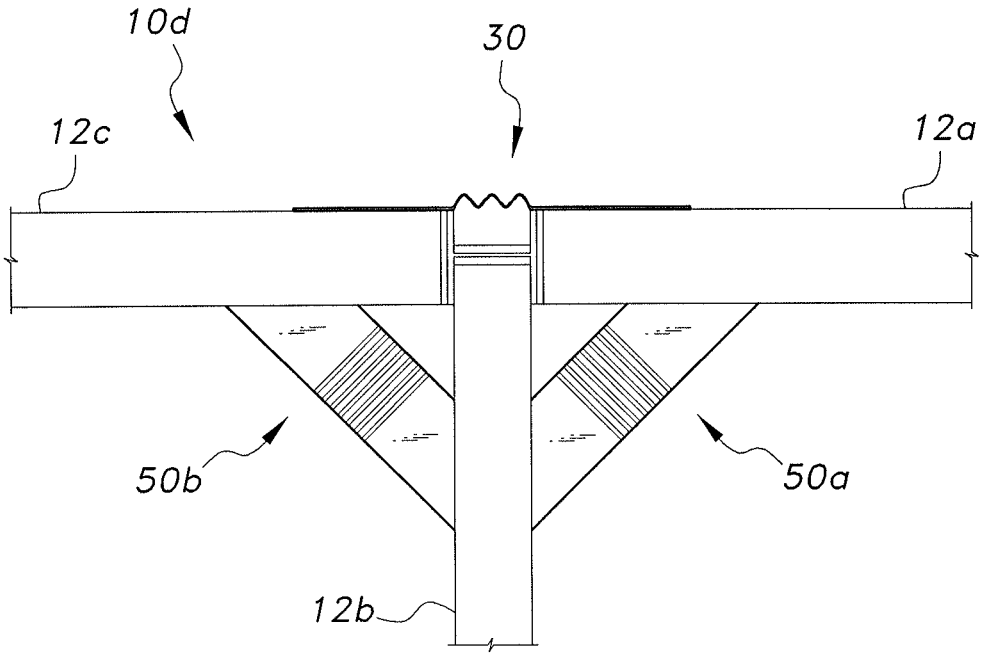
FIG. 22 is a top view of the strengthening system of FIG. 21, showing horizontal rippled plate in an unextended condition connecting the transverse beams and a vertical rippled plate connecting in-plane beams.

FIGS. 21 and 22 show a sixth embodiment of the strengthening system for beam-column connection in steel frame buildings to resist progressive collapse. The fifth embodiment teaches a system for use in beam-column external joints 10*d*, having three connecting beams 12*a-c*. This type of beam-column connection 10*d* would likely be located on the outside of a building where two beams 12*a*, 12*c* are coplanar and one beam 12*b* is perpendicular, forming a "T". This system uses two horizontally oriented rippled plates 50*a*, 50*b*, similar to the plates of the fourth embodiment, and one vertically rippled plate 30, similar to the plates of the second embodiment. The first horizontally oriented ripple plate 50*a* is connected to the transverse steel beams 12*a*, 12*b* by mounting portions welded to the lower flanges of the beams 12*a*, 12*b*. The second horizontally oriented rippled plate 50*b* is connected to the transverse beams 12*b*, 12*c* by mounting portions welded to the lower flanges of the beams 12*b*, 12*c*. The in-plane beams 12*a*, 12*c* are connected by a vertically oriented rippled plate 30, seen best in FIG. 22, which spans the column 14 on the side opposite the perpendicular beam 12*b*. The vertically oriented ripple plate 30 is connected to the beams 12*a*, 12*c* similar to the previously discussed vertically oriented plates. When the column 14 is displaced downward, the plates will resist separation of the joint, as discussed in the previous embodiments.

Figure 23:
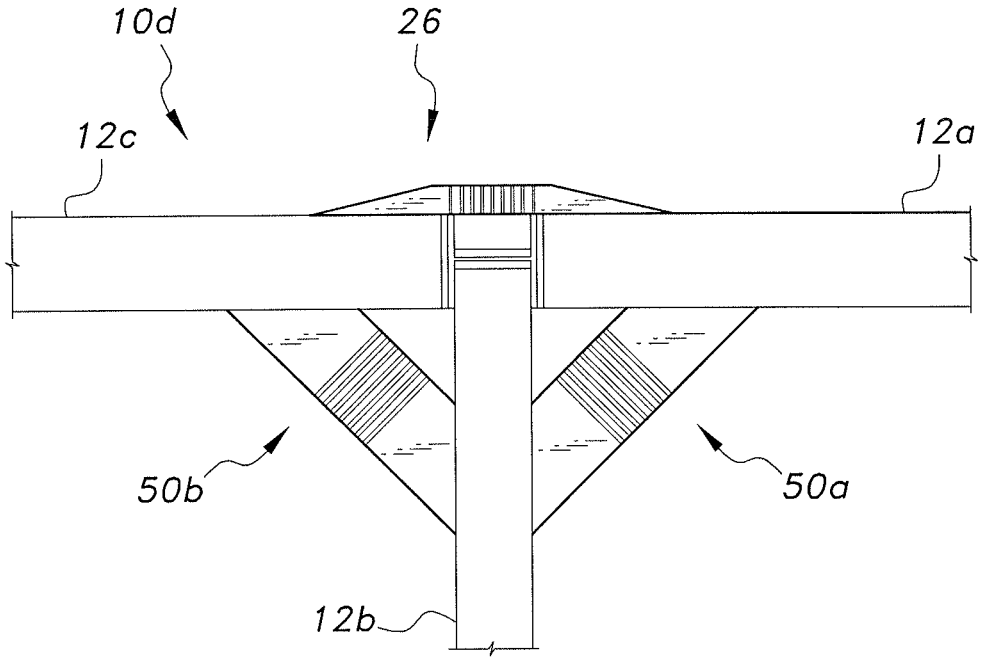
FIG. 23 is a top view of a seventh embodiment of a strengthening system for beam-column connection in steel frame buildings to resist progressive collapse, showing an external joint and horizontal rippled plates in an unextended condition connecting the transverse beams and a horizontal rippled plate connecting in-plane beams.
Figure 24A:
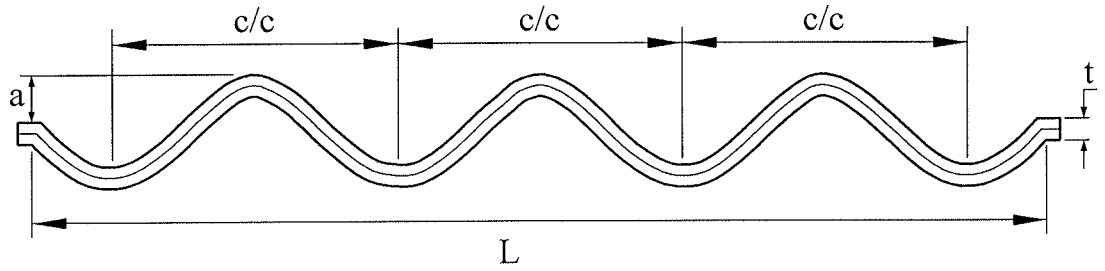
FIGS. 24A, 24B, 24C, 24D, 24E, 24F, 24G, and 24H are side elevation views showing different rippled plate configurations of the strengthening system for beam-column connection in steel frame buildings to resist progressive collapse.
Figure 24B:
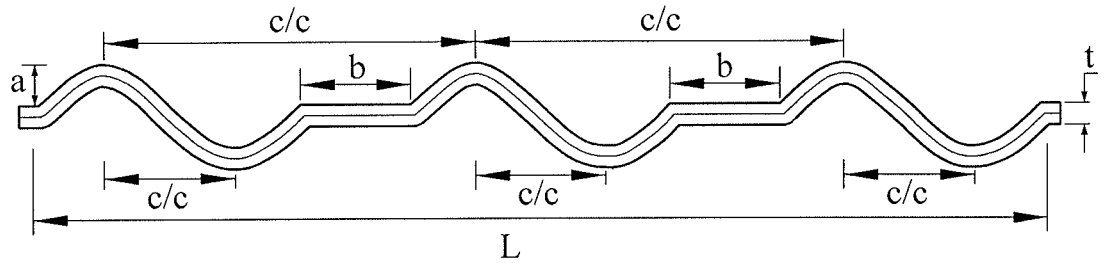
Figure 24C:
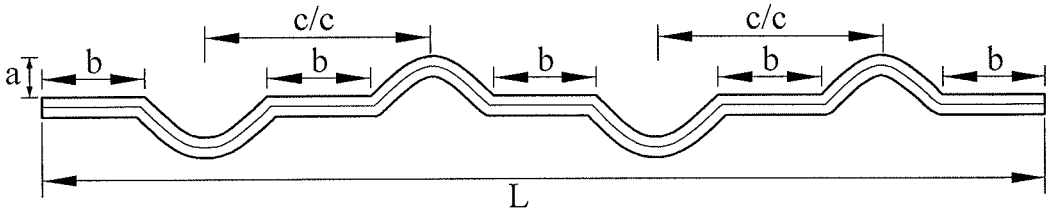
Figure 24D:
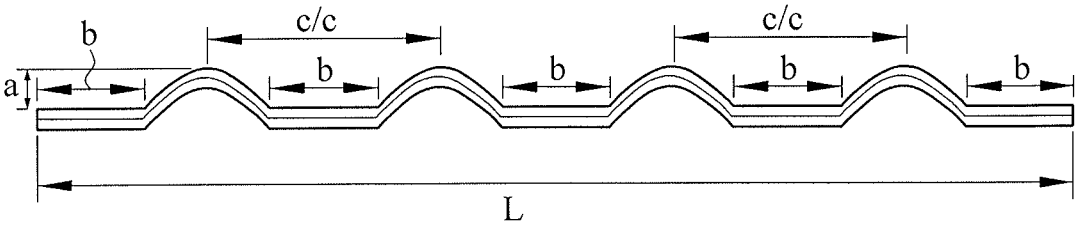
Figure 24E:
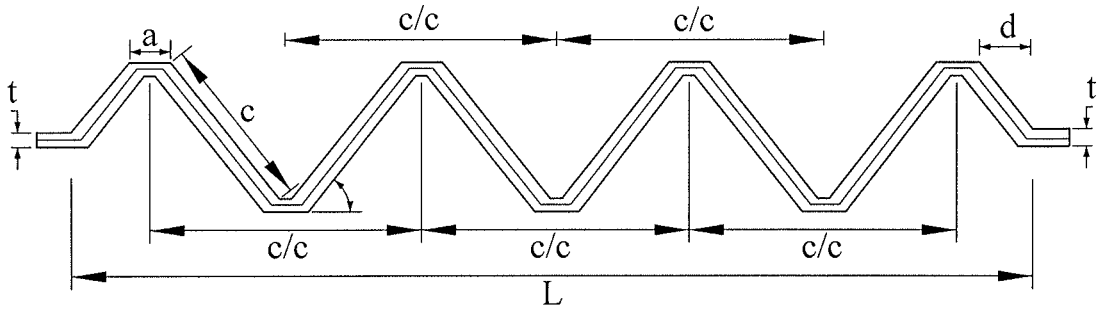
Figure 24F:
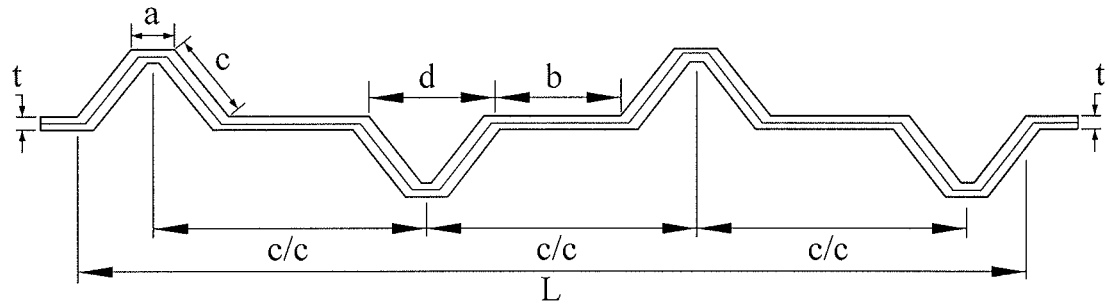
Figure 24G:
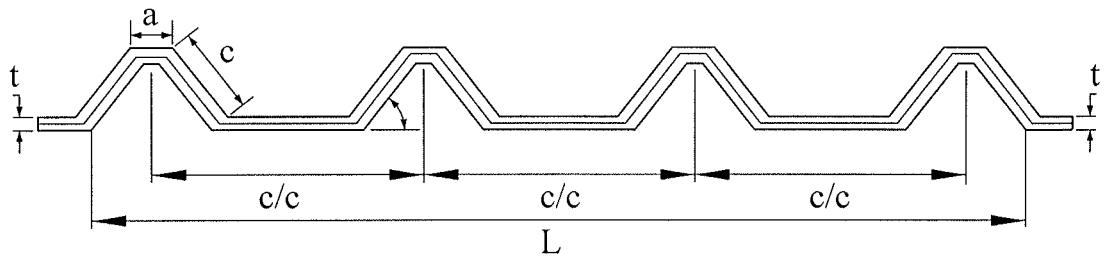
Figure 24H:
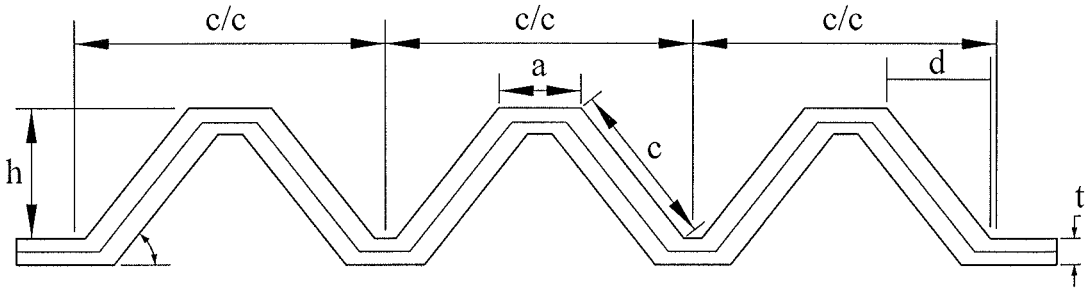

FIG. 23 shows the external joint 10*d* reinforced using three horizontally oriented rippled plates. The plate 26 connecting the two in-plane beams 12*a*, 12*c* is similar to the plates 20*a*, 20*b* of the first embodiment, which have two mounting tabs 22*a*, 22*b* that attach to the lower flange of the beams 12*a*, 12*c* and a rippled portion that extends out from the beam to span the column 14. The other two plates 50*a* and 50*b* are similar to the plates of the previous embodiment.

The rippled plates attached to the joints 10*a-d* will be almost dormant (although it adds a small amount of rigidity to the joint under service loads) during the service life of the structure and become active during the progressive collapse of the steel frame. As discussed above, the failure of a column exposed to a blast load causes sudden downward movement of its upper end that may lead to the progressive collapse of the structure. In this process, the rippled plates start stretching, and the amount of stretching increases with the increase in the downward movement of the joint of the failed column. This helps in restraining the downward movement by connecting the beams across the damaged joint, and hence developing catenary action in the beams. Thus, the proposed addition of rippled plates helps in blast damage mitigation without altering the behavior of the beam-column joint under service loads In a preferred embodiment, each beam-column connection of a steel frame building includes a rippled plate. By including the plates at each connection, the load on the column can be distributed to the adjacent joints. For example, if an explosion removes a portion of a column on the first floor of a building, the load on the column will be carried by all of the joints above the column. Therefore, there will only be a fraction of the load on each joint, as the load is transferred to the adjacent columns. Additionally, the load on the joints would remain fairly constant independently of the location of the failure.

Figure 26:
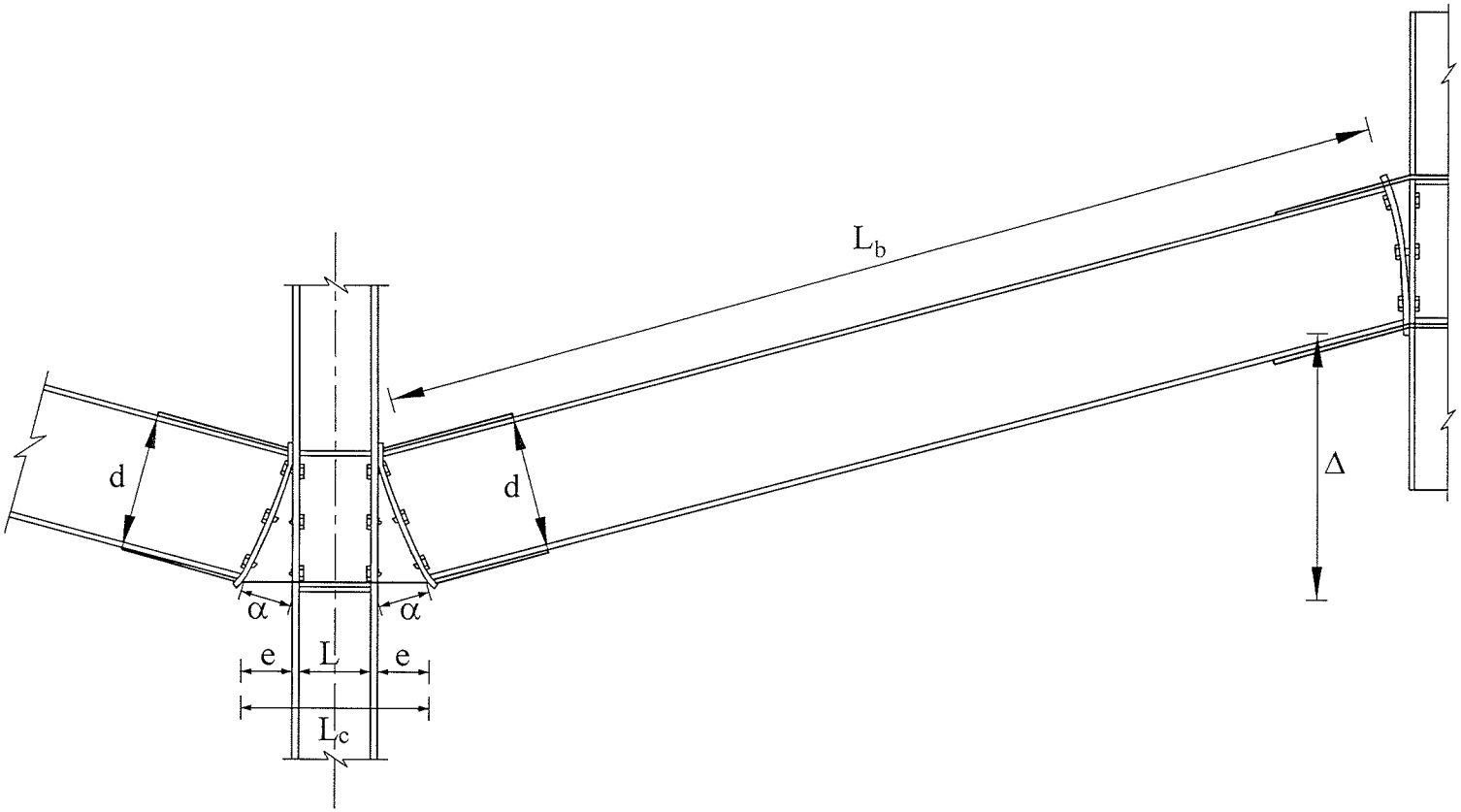
FIG. 26 is a simplified diagram showing the deflected shape of a beam-column steel frame (having in-plane beams) strengthened with a rippled plate to resist progressive collapse due to the failure of a column.

It is further contemplated to additionally attach plates to the upper portion of beams, as shown on the right side of FIG. 26, or include vertically oriented rippled plates with the ripples tapering inwards in the downward direction. When the load of the damaged column is transferred to the adjacent columns, the column beam connection will be subjected to opposite forces. Accordingly, there will be a force pulling the upper edge of the beam away from the column. Reinforcing this portion of the beams may further assist in mitigating or avoiding progressive collapse.

The plates may be secured to the beams by welding, heavy duty bolts, or other known methods in the art for connecting high strength steel components. Although the proposed connections are shown for some typical existing beam-column connections, these can be easily implemented in all types of steel beam-column connections, such as Simple (pinned) connections, (ii) Semi-rigid connections, (iii) Moment connections, and other connections known in the art.

The size of connection plates shall be decided based on the design. However, the thickness of the rippled plates may preferably vary from the thickness of the flange to a slightly heavier gauge, and the width may vary from one-half of the width of the beam flange to slightly more.

The beam-column joints reinforced by rippled plates are fast to construct because the proposed reinforcement doesn't need any modifications/alterations to the existing beam-column connections. The connections are made using commercially available steel plates. The ripples can be created in steel plates by hydraulic pressing of the plate against a die of the desired shape, or by rolling. These plates may also be molded in steel factories. Furthermore, the system is simple, as no specialist knowledge is required in the analysis, design and construction of the proposed system. In addition, the system does not require very precise construction and fabrication tolerance.

The plates are also capable of removal without damage to the existing structure. Further, the plate can be removed relatively quickly when a progressive collapse of the building is desired for demolition purposes.

The shapes of ripples may be sinusoidal, triangular, square, trapezoidal, saw-tooth, etc. with or without rounded peaks. FIGS. 24A-24H show examples of ripple shapes for use in the above mentioned rippled areas, although other ripple configurations may be used. Each shape has different stress-strain characteristics that can be matched to specific structures based on requirements and tolerances of the structure. The stress-strain characteristics can be affected by shape of the ripples, angle of the ripples, non-rippled portions dispersed between the rippled portions, and height of the ripples.

Figure 25:
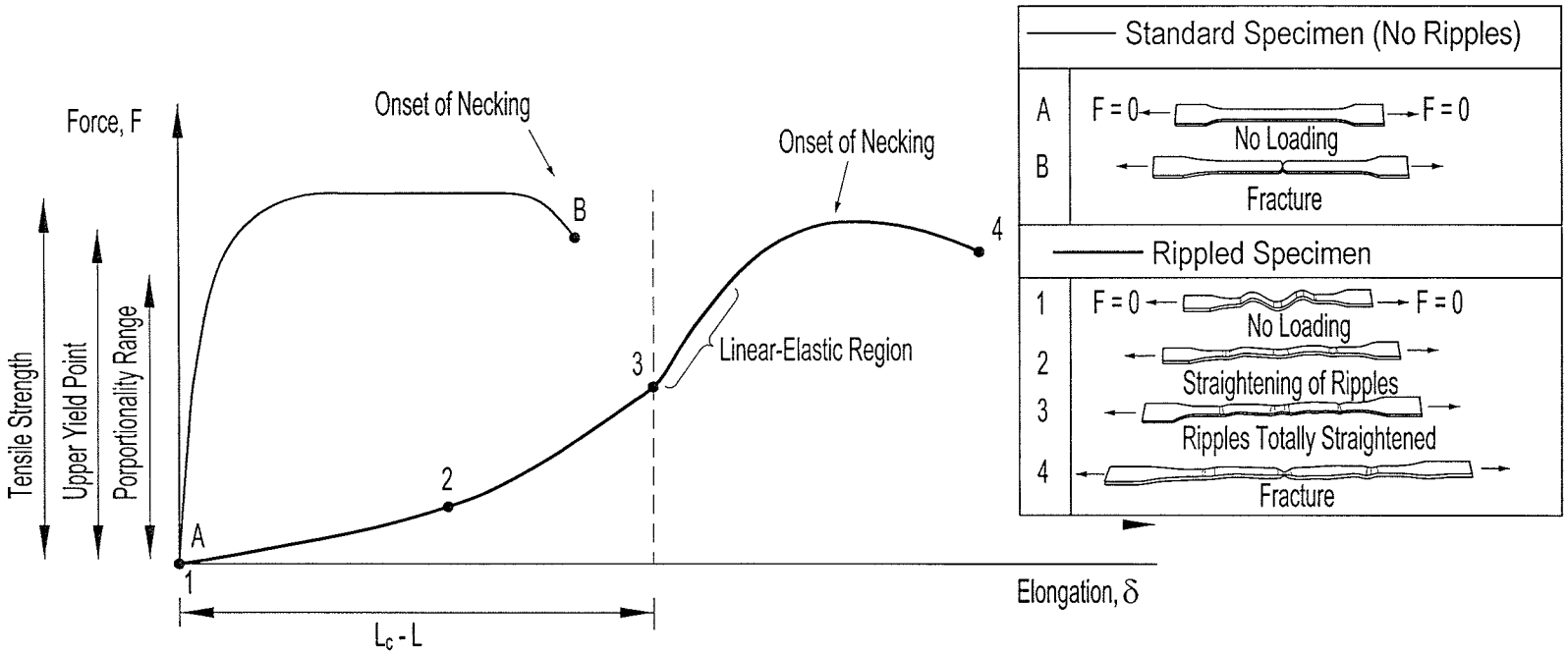
FIG. 25 is a chart showing a comparison between the ductility in a straight steel plate and a rippled steel plate of the same composition.

FIG. 25 shows a load-displacement curve of an unrippled, straight steel plate versus a rippled steel plate. The straight piece of steel shows a very steep plastic deformation portion, indicated by the linear section at the beginning of the plot. Therefore, the plate will initially be very stiff and resist elongation unless a very large force is applied. Once plastic deformation begins, as indicated by the curved portion of the plot, the plate begins to experience more elongation. Shortly after plastic elongation begins, the force carried by the plate remains constant, and with increased elongation, the necking starts and force drops off right before breaking. This plot indicates that the straight plate may be problematic for impact type forces that will produce a large amount of force quickly. The straight plate will not absorb any of the impact force. It will immediately transfer the force to other portions of the structure that may be susceptible to failure. Additionally, the large initial force may quickly overcome the elastic deformation section, causing the plate to neck and ultimately fail.

In contrast, the plot of the rippled plate begins with a gradual linear elastic section where the ripples elastically deform, similar to a spring. This is followed by a slightly steeper plastic deformation portion, where the ripples are straightened out. Following the plastic deformation region of the ripples straightening is another linear elastic region of the straightened plate elastically stretching in length. This is followed by necking and ultimate failure of the plate. The gradually inclining plot of the rippled plate indicates that much of an impact force will be dispersed over an extended period of time through lengthening, thus resulting in lower forces over a longer period of time. This will result in lower maximum forces on the joint, the plate, and the surrounding joints, thereby preventing ultimate failure of components of the structure.

FIG. 26 shows the damage of a column by exposure to the blast generated waves for a beam-column connection having coplanar beams. The column damage causes vertical deflection A of its beam-column connection, leading to the rotation of beams a, which is approximately given by:

$$\alpha = \frac{\Delta}{L}. \tag{1}$$

The above formula assumes the beams to remain straight, and hence the actual value of angle α will be less. The downward vertical movement of the joint causes differential stretching of the rippled steel plate at the connection of the damaged column. The stretching of the vertical rippled plate is more at the bottom and less at the top of the rippled plate. The extension of the rippled plate at the bottom edge of the plate is equal to the opening of the joint at the bottom level of the beam, which can be approximately calculated from:

$$2e \cong 2\alpha d = \frac{2d\Delta}{L_b}, \tag{2}$$

where, d is the depth of the beam, and $L_b$ is the length of the beam. Thus, the length of the rippled portion after stretching will be $L_c$=L+2e, where L is the initial length of the rippled portion, as shown in FIG. 26. The stretching of a vertical rippled plate at the top may be calculated by linear proportion, with its value being nearly zero at the top level of the beam. For the horizontal rippled plate, the stretching will be 2e, e being the distance between the lower end of the beam and the column. However, a better estimate for e can be obtained from the structural analysis.

The angle (α) indicates the angular displacement between the beam and column. A maximum deflection of Δ=kd can be resisted by the steel beam-column connection, where k varies from 1 to 2, depending on the type of connection, members, and material characteristics. As the span to depth ratio for steel framed beams varies from 16 to 24, the value of 2e may vary from 0.1 d to 0.25d. By keeping the numbers, amplitudes, and shapes of ripples such that their straightening causes an extension of magnitude equal to 2e, the rippled plate will start taking the load even before the total failure of the joint. This is because the rippled plate starts taking the load right from the initiation of stretching of ripples, but initially the resistance offered is low. However, it becomes considerable even before the complete straightening of rippled plate. The resistance offered by the rippled plate will hold further downward movement of the joint, thereby preventing progressive collapse of the building.

Figure 27:
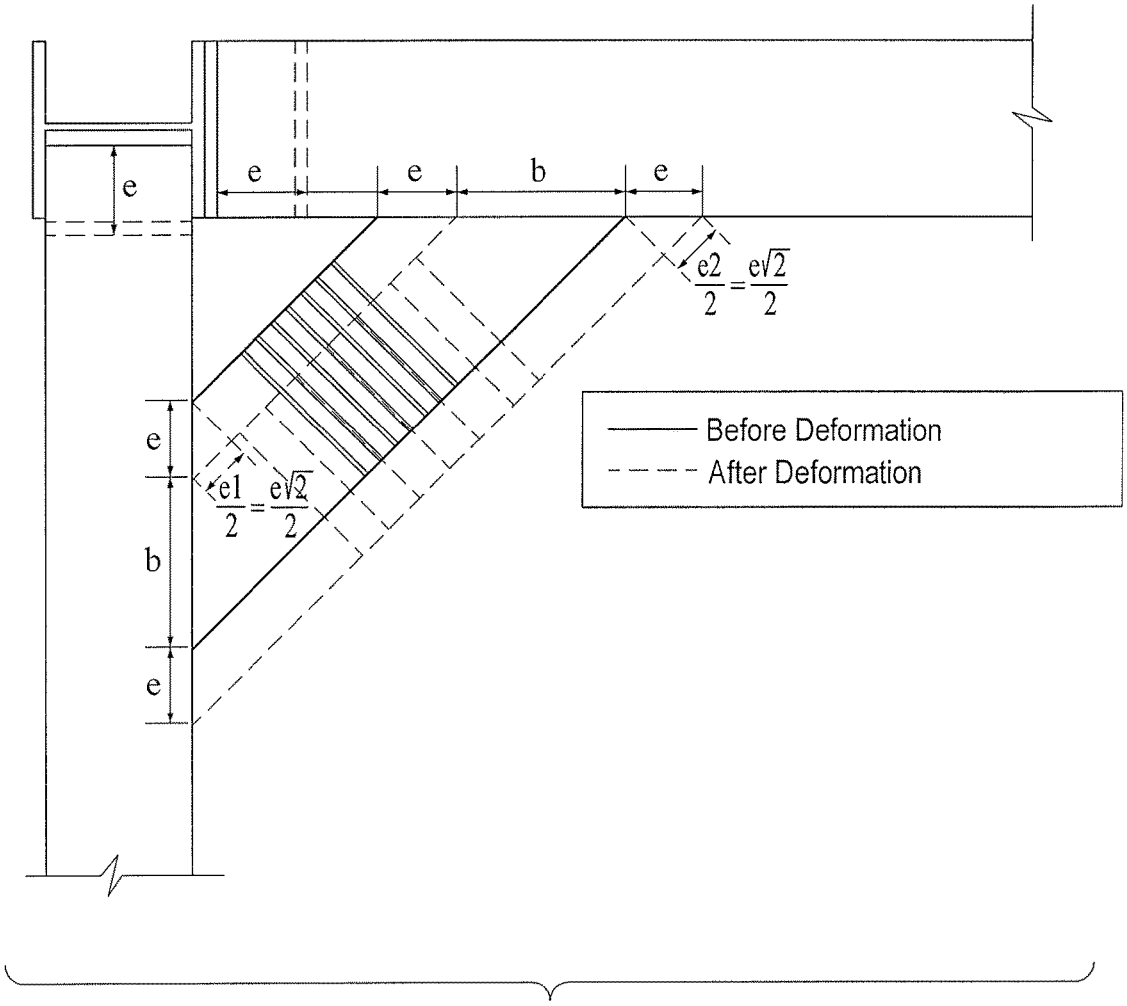
FIG. 27 is a simplified diagram showing the deflected shape of a beam-column steel frame (having transverse beams) strengthened with a rippled plate to resist progressive collapse due to the failure of a column.

FIG. 27 shows a plan view of stretching of rippled plates connected to the transverse beams. The rotation of the beam at the column damaged by exposure to the blast generated waves is the same as shown in FIG. 26. Thus Eq. (1) is also valid for this connection as well. However, the value of e given by Eq. (2) is equal to the displacement of the rippled plate along the beam axis. Thus, the stretching of the steel rippled plate at the inner and outer edges, e1 and e2 respectively, are given by:

$$e1 = e2 = e\sqrt{2} \cong \frac{\sqrt{2}\,d\Delta}{L_b}. \tag{3}$$

The design of ripples for connecting in-plane and transverse beams should be such that the extension of the rippled plate after the straightening of ripples is equal to the stretching calculated above. The ripple configurations shown in FIGS. 24A-24H can be adopted, depending on the design requirement.

It is to be understood that the strengthening system for beam-column connection in steel frame buildings to resist progressive collapse is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A plate for a strengthening system for beam-column connection in steel frame buildings to resist progressive collapse, the plate comprising a steel plate having:

a first mounting portion and a second mounting portion, the mounting portions being adapted for attachment to a lower flange of opposing I-beams extending from a column on opposite sides of the beam-column connection; and a central rippled portion extending between the first and second mounting portions, the central rippled portion having rippled portions and being dimensioned and configured for spanning the column between the opposing I-beams;

whereby, upon exposure to blast forces, the rippled portions straighten to compensate for forces pulling a lower portion of the opposing I-beams away from the beam-column connection, thereby resisting progressive collapse by catenary action.

2. The plate for a strengthening system according to claim 1, wherein each said mounting portion comprises a rectangular section adapted for attachment to the lower flange of one of the opposing I-beams and a right trapezoidal section extending from the rectangular section, the right trapezoidal sections being adapted for extending from the lower flange of the opposing I-beams, the right trapezoidal sections supporting opposite ends of the ripple portion, the ripple portion being adapted for extending horizontally beside the column.

3. The plate for a strengthening system according to claim 1, wherein each said mounting portion comprises an angle having a horizontal flange adapted for attachment to the lower flange of one of the opposing I-beams and a vertical flange adapted for extending perpendicular to the lower flange of one of the opposing I-beams, the vertical flanges supporting opposite ends of the ripple portion, the ripple portions being adapted for extending vertically beside the column.

4. The plate for a strengthening system according to claim 3, wherein said ripple portion has a height dimensioned and configured for extending only a fraction of a height of the webs of the opposing I-beams.

5. The plate for a strengthening system according to claim 3, wherein said ripple portion has a height dimensioned and configured for extending the entire height of the webs of the opposing I-beams.

6. The plate for a strengthening system according to claim 3, wherein said ripple portion comprises a plurality of ripples tapering in width from wide to narrow in a direction from an edge of the vertical flange joined to the horizontal flange to an opposite free edge of the vertical flange, the ripples being dimensioned and configured for spreading wider where the lower flange separates from the column than higher up the beam-column connection when the beam-column connection fails.

7. A strengthening system for beam-column connection in steel frame buildings to resist progressive collapse, the system comprising:

a beam-column joint including a steel I-beam column extending vertically and at least one pair of opposing beams made of steel I-beam extending horizontally from a column in opposite directions, each of the opposing beams having an upper flange, a lower flange, and a web extending between the upper and lower flanges, the webs of the opposing beams being coplanar; and at least one reinforcing plate disposed on opposite sides of the column, the at least one reinforcing plate having:

a first mounting portion and a second mounting portion, the mounting portions being attached to the lower flange of a pair of the beams extending from the column; and a central rippled portion having rippled portions extending between the first and second mounting portions;

whereby, upon exposure to blast forces, the rippled portions of the reinforcing plates straighten to compensate for forces pulling a lower portion of the beams away from the beam-column joint, thereby resisting progressive collapse by catenary action.

8. The strengthening system according to claim 7, wherein said beam-column joint comprises an internal joint, said at least one pair of opposing beams comprising two pairs of opposing beams, the two pairs extending from the column perpendicular to each other.

9. The strengthening system according to claim 8, wherein said at least one reinforcing plate comprises two pairs of reinforcing plates disposed perpendicular to one another on opposite sides of the column, the first and second mounting portions of each of the reinforcing plates being attached to the lower flange of a pair of the opposing beams so that the rippled portions of the two pairs of reinforcing plates span all four sides of the column.

10. The strengthening system according to claim 8, wherein said at least one reinforcing plate comprises two pairs of reinforcing plates, the first mounting portion of each of the reinforcing plates being attached to the lower flange of one of the beams and the second mounting portion being attached to the lower flange of one of the beams transverse thereto and the two pairs of reinforcing plates being perpendicular thereto so that the rippled portions of the two pairs of reinforcing plates extend diagonally between adjacent beams around the column.

11. The strengthening system according to claim 7, wherein said beam-column joint comprises an external joint, said at least one pair of opposing beams consisting of a single pair of opposing beams, the joint having a single transverse beam extending from the column perpendicular to the opposing beams.

12. The strengthening system according to claim 11, wherein said at least one reinforcing plate comprises:

a first reinforcing plate spanning the column on a side opposite the single transverse beam;

a second reinforcing plate on the same side of the column as the transverse beam, the second reinforcing plate having the first mounting portion attached to one of the opposing beams and the second mounting portion attached to the transverse beam; and a third reinforcing plate on the same side of the column as the transverse beam, the third reinforcing plate having the first mounting portion attached to the other opposing beam and the second mounting portion attached to the transverse beam.

13. The strengthening system according to claim 7, wherein said at least one pair of opposing beams have flexible end plates attaching the beams to the column.

14. The strengthening system according to claim 7, wherein said at least one pair of opposing beams have fin ends attaching the beams to the column.

15. The strengthening system according to claim 7, wherein the central rippled portion of said at least one reinforcing plate extends horizontally.

16. The strengthening system according to claim 7, wherein the central rippled portion of said at least one reinforcing plate extends vertically.

17. The strengthening system according to claim 16, wherein said central rippled portion comprises a plurality of ripples having an upper end and a lower end, the lower end of the ripples being wider than the upper end for spreading wider where the lower flange of the beams separates from the column than higher up the beam-column joint when the beam-column joint fails.

18. A method of strengthening beam-column connections of a steel frame building to prevent progressive collapse comprising the step of mounting rippled reinforcing plates to a beam of a beam-column joint to resist progressive collapse by catenary action, wherein the rippled reinforcing plates have a central rippled portion having rippled portions, further wherein the step of mounting rippled reinforcing plates comprises mounting the rippled reinforcing plates so that the rippled portions span opposite sides of a column.

19. The method of strengthening beam-column connections according to claim 18, wherein said step of mounting rippled reinforcing plates comprises mounting the rippled reinforcing plates so that rippled portions extend between in-plane and transverse beams.

* * * * *